US006290079B1

(12) United States Patent
Altherr

(10) Patent No.: US 6,290,079 B1
(45) Date of Patent: Sep. 18, 2001

(54) COUPLER FOR RAILROAD CARS

(75) Inventor: Russell G. Altherr, Munster, IN (US)

(73) Assignee: Sharma & Associates, Inc., Hinsdale, IL (US)

( * ) Notice: Subject to any disclaimer, the term of this patent is extended or adjusted under 35 U.S.C. 154(b) by 0 days.

(21) Appl. No.: 09/526,675

(22) Filed: Mar. 16, 2000

Related U.S. Application Data

(60) Provisional application No. 60/124,919, filed on Mar. 17, 1999.

(51) Int. Cl.[7] ..... B61G 5/06

(52) U.S. Cl. ..... 213/1.3; 213/1.6; 213/76; 213/75 GT; 439/195; 439/191; 439/700; 439/823

(58) Field of Search ..... 213/1.3, 1.6, 76, 213/75 GT; 439/195, 191, 700, 823

(56) References Cited

U.S. PATENT DOCUMENTS

| | | | | |
|---|---|---|---|---|
| 599,782 | * | 2/1898 | Harding | 213/1.3 |
| 1,749,149 | * | 3/1930 | Mead | 213/1.6 |
| 1,856,455 | * | 5/1932 | Banks et al. | 213/1.3 |
| 3,249,239 | | 5/1966 | Herbert et al. | 213/1.6 |
| 3,251,480 | | 5/1966 | DePenti et al. | 213/1.3 |
| 3,263,823 | | 8/1966 | Gobrecht | 213/1.6 |
| 3,280,990 | * | 10/1966 | Jefferey et al. | 213/76 |
| 3,549,021 | | 12/1970 | Metzger | 213/110 |
| 3,549,022 | | 12/1970 | Metzger | 213/110 |
| 3,552,580 | | 1/1971 | Cope | 213/1.3 |
| 3,591,017 | | 7/1971 | Cope | 213/76 |
| 3,773,186 | | 11/1973 | Reno et al. | 213/1.3 |
| 3,812,444 | * | 5/1974 | Reno | 339/15 |
| 3,842,987 | * | 10/1974 | Prada | 213/1.3 |
| 3,895,850 | * | 7/1975 | Engle et al. | 339/15 |
| 4,284,311 | * | 8/1981 | Forster et al. | 339/10 |
| 4,486,060 | * | 12/1984 | Currall | 339/15 |
| 4,917,619 | * | 4/1990 | Nishiwaki | 439/191 |
| 5,586,668 | | 12/1996 | Miller | 213/1.3 |
| 5,899,753 | * | 5/1999 | Wong et al. | 439/17 |

* cited by examiner

*Primary Examiner*—S. Joseph Morano
*Assistant Examiner*—Frantz F. Jules
(74) *Attorney, Agent, or Firm*—Wallenstein & Wagner, Ltd.

(57) ABSTRACT

An apparatus is provided for connecting electric and air lines of railroad cars incident to their mechanical coupling. The connector includes a junction plate with an outer perimeter surrounded by a housing that has connector-to-connector gathering means and is resiliently attached to a bracket on the coupler body. Formed near to the geometric center of the junction plate is a hole retaining a gasket which seats against the end of an elongated tube mechanically secured to the junction plate and passing through a compression spring and the housing and its remote wall where the assembled length is controlled by the flange of an air line fitting contacting the housing. The automatic electric and air line capability supplements the automatic coupling capability within an increased gathering range.

12 Claims, 10 Drawing Sheets

12% RATIO OF AREAS FOR 2 OPEN KNUCKLES

21% RATIO OF AREAS FOR 2 OPEN KNUCKLES

66% RATIO OF AREA FOR 2 OPEN KNUCKLES

EFFECT OF WEAR ON SPRING FORCES

COUPLER FOR RAILROAD CARS

RELATED APPLICATIONS

This application claims the benefit of U.S. Provisional Application No. 60/124,919, filed Mar. 17, 1999.

DESCRIPTION

1. Technical Field

The present invention generally relates to couplers for railroad cars, and in particular to automatic couplers, herein referred to as a Tricoupler, for connecting electric and air lines of railroad cars incident to their mechanical coupling.

2. Background of the Invention

Currently, railway freight cars in interchange service in the United States, Canada and Mexico use knuckle couplers approved by the Association of American Railroads (AAR). These couplers are prepared for uncoupling by placing the lock of one or both couplers in lockset condition by manually lifting the operating rod at the side of the car. In separating the cars, one or both knuckles open and the open knuckle coupler is automatically available for recoupling to any other AAR approved coupler. If it is desired to couple two cars, both having their knuckles closed, one of them must have the knuckle thrown open manually. However, they may only gather and couple reliably within a limited range of displacement of their coupler center lines at the coupling plane or pulling face.

Each car is equipped with air operated brakes controlled at the locomotive through a train air line extending the length of the train by manually joining the line between adjacent cars. To join the air line, a workman must go between the cars and between the rails, a very dangerous and time consuming job. After closing the angle cock at the end car, the brake system is filled with air from the locomotive compressor or sometimes with ground air. Once the system is filled with air, the brakes can be applied by a reduction of pressure in the air line. This reduction of pressure is initiated at the locomotive and transmitted to the cars through the air brake lines. As expected in such a system, the pressure reduction is not instantaneous but propagates from the locomotive to the end of the train.

It has been proposed in the railroad industry that great benefits could be realized by electrically controlling the air brakes from the locomotive. Electrically Controlled Pneumatic (ECP) braking systems allow simultaneous reductions in brake pressures in all the desired cars, thereby resulting in a more uniform and immediate brake application. Run-in impacts could be minimized, stop distances could be reduced, there would be a potential for reducing train action forces by selective braking, and even a possibility of selectively cutting the train. Since ECP brakes are initiated by electric signals, there is a need for electrical communications from the locomotives to the cars. These may be accomplished either through electrical cable connections or through remote radio frequencies.

Current coupling systems provide two separate mechanisms for coupling two adjacent cars. The automatic knuckle coupler connects the two cars mechanically while, the air lines are connected manually through the use of gladhands. With the advent of ECP brakes, there is an additional need to connect the cars electrically. Hence, there is a need for coupler systems that will automatically couple two cars mechanically, pneumatically and electrically.

SUMMARY OF THE INVENTION

The present invention is a mechanically compatible knuckle type coupler that attaches to standard couplers and provides for air and electric connections (up to 5 wires), expanded gathering range, and is ready for coupling at all times. This invention offers many safety benefits to the railroad workers involved in train make up operations as well as to the operation of trains in revenue service. These benefits include: (1) workers will not have to go between cars or cross over between cars to position couplers, manually open knuckles, connect air lines, connect electric cables, operate angle cocks, etc.; and, (2) the presence of an electrical cable connection offers many possibilities for enhancing safety of railroad operations including application of handbrakes remotely, coupling and uncoupling operations by remote control or by activation from the locomotive, and environment monitoring of various car functions such as ride quality, hot bearings, temperature control of car lading on heated/refrigerated cars, etc.

There are also significant economic benefits due to reduced train make up time, significant savings in labor costs, reduced lading loss to temperature sensitive cargo, and early detection of car defects such as hot bearings (thereby reducing derailment potential).

In an embodiment, the present invention includes a connector having a junction plate with an outer perimeter surrounded by a housing. Formed within the geometric center of the junction plate is a bore for receiving a portion of an elongated tube. Wrapped about the outer surface of the tube is a coil spring abutting against both the housing and the junction plate. Moreover, symmetrically positioned about the opening of the bore are a plurality of spring-loaded electrical contacts.

BRIEF DESCRIPTION OF THE DRAWINGS

In the accompanying drawings forming part of the specification, and in which like numerals are employed to designate like parts throughout the same.

DETAILED DESCRIPTION

Figure 3:
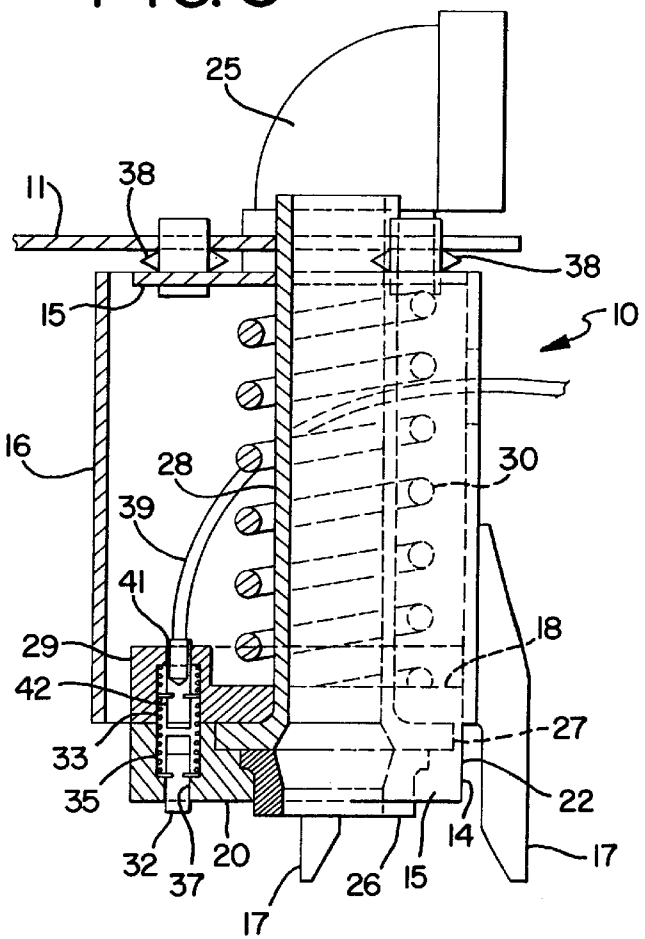
FIG. 3 is a longitudinal partial cross-sectional view of the connector of FIG. 2 along line 3—3.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 1:
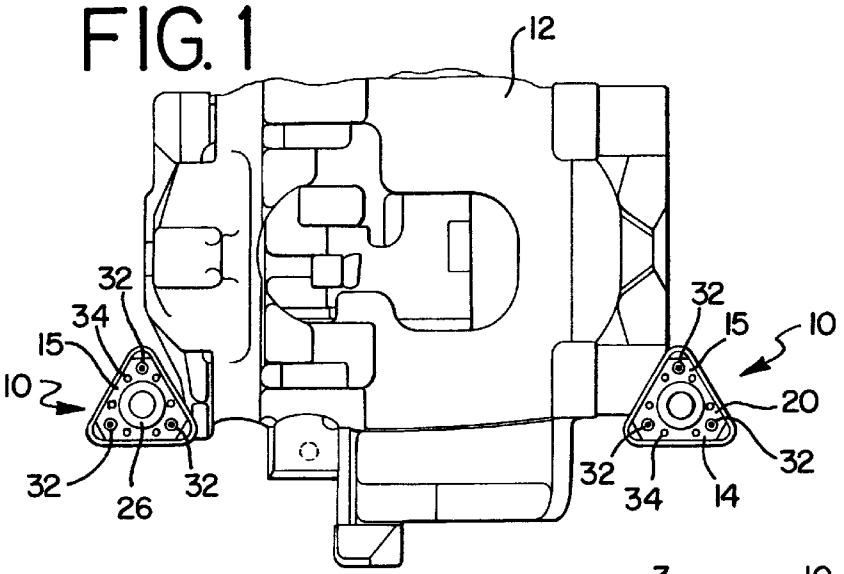
FIG. 1 is an end view of a railroad car coupler with two connectors in accordance ention attached thereto.
Figure 2:
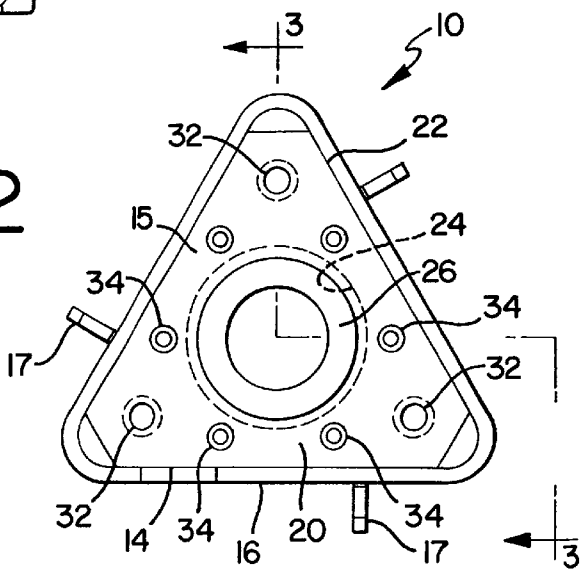
FIG. 2 is an end view of one of the connectors of FIG. 1.

Referring to FIGS. 1–3, one or more connectors 10 are attached, via a bracket 11, to a railroad car coupler 12. Each connector 10 includes a junction plate assembly 14 resiliently mounted to a housing 16 and including a front plate 15 and a back plate 29 attached together by screws 34 or the like. The junction plate assembly 14 has an inner surface 18 and a planar outer surface 20 with a generally triangular perimeter 22.

Formed within the geometric center of the junction plate assembly 14 is a hole 24 for receiving a portion of both a cylindrical gasket 26 and a flange 27 of an elongated tube 28 extending from the outer surface 20 and the inner surface 18, respectively, of the junction plate assembly 14. The tube 28 is generally in coaxial alignment with the longitudinal axis of the housing 16 and projects through an aperture in the housing opposite junction plate assembly 14. Attached to an end of the tube 28 opposite the junction plate assembly 14 is a tubular elbow or pipe fitting 25 operably attached to a flexible air hose or the like (not shown) for connecting to an air brake line of a railroad car.

Back plate 29 contains a perimeter shape identical to and aligned with the perimeter 22 of front plate 15, a central hole through which the tube 28 passes, and a counterbore. Both the front plate 15 and the back plate 29 have holes 33 to receive flanged electrical connectors 32 and connector springs 35. A reduced diameter hole 37 at outer surface 20 allows the connector 32 end to project beyond the outer surface 20 for contact with a like part of an adjacent coupler connector. When depressed, the flanged electrical connectors 32 are operably coupled via conductive tube members 42 to respective lead wires 39 that pass through a grommet protected opening 41 in the back plate 29. Both the front plate 15, the back plate 29 and the tube flange 27 contain aligned fastener holes which are counterbored in plates 29 and 15 to accommodate the fastener ends. Each conductive tube member 42 receives an end portion of an associated electrical connector 32 when the connector is depressed to form an electrical contact between the tube and the connector. However, when the connector 32 is not depressed, a space is provided between the connector and its respective tube member 42 so the connector will not become energized by the existence of power on lead 39, if any.

As indicated previously, a coil spring 30 is wrapped about the outer surface of the tube 28 and abuts against both the housing 16 and the inner surface 18 of the junction plate assembly 14. Accordingly, spring 30 is compressed by applying force against the junction plate assembly's outer surface 20.

Symmetrically positioned about the opening to the bore 24 within the junction plate assembly 14 are a plurality of electrical contacts 32. Each electrical contact is spring-loaded and, when not compressed, extends a preselected distance from the outer surface 20 of the junction plate assembly 14.

As stated previously, the connector 10 is mounted to the coupler 12 of a railroad car. One connector can be mounted along the axis of symmetry of the railroad car or, alternatively, a pair of connectors 10 can be mounted to the sides of the coupler 12.

As two railroad cars having connectors 10 are adjoined together, the junction plate assemblies 14 of opposing connectors abut together to provide an air connection, via a bore 24, and a plurality of electrical connections between the cars.

Figure 12:
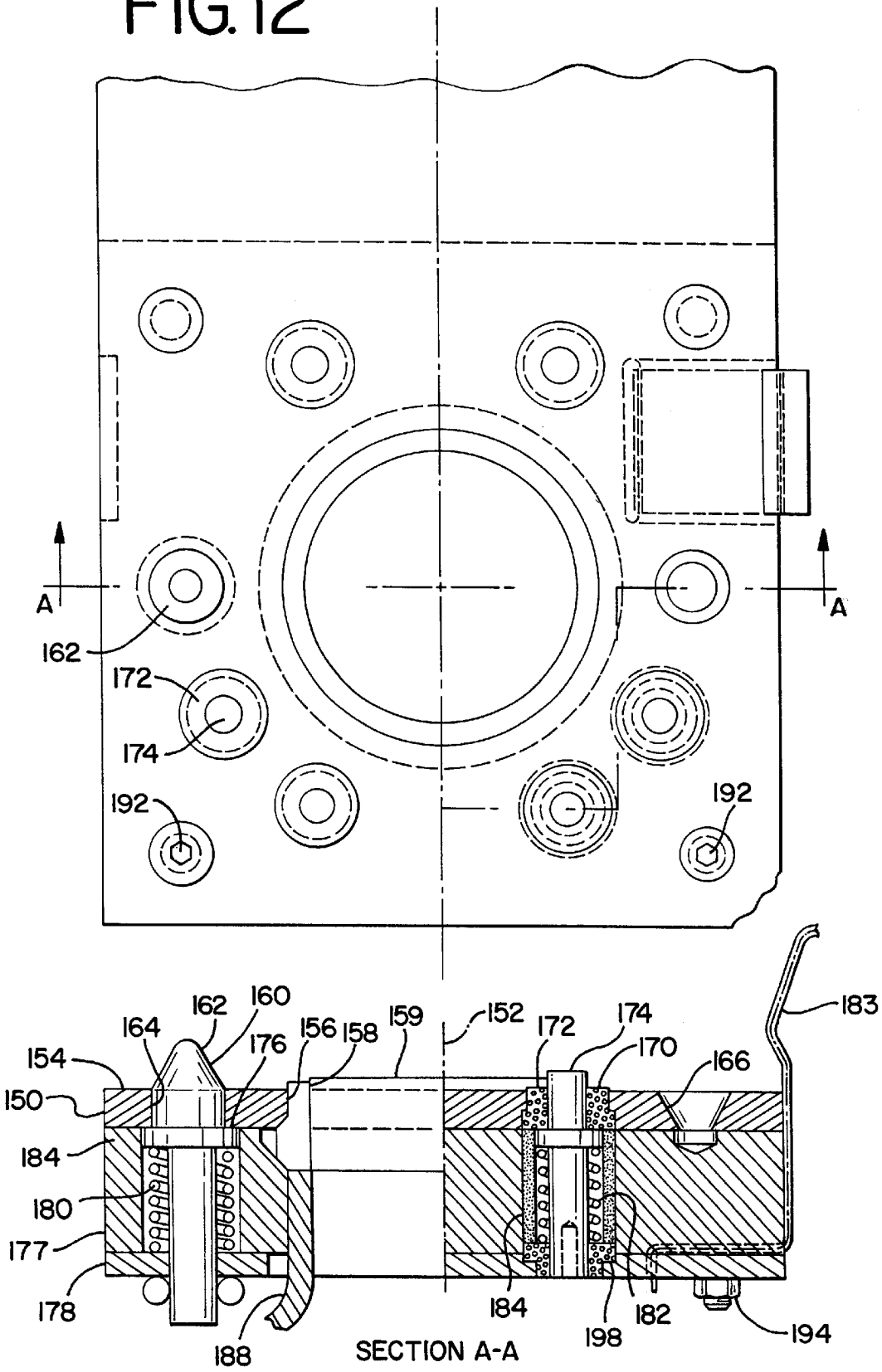
FIG. 12 is a vertical view of the face of another embodiment of a connector plate assembly its section A-A.

Turning to FIG. 12, to facilitate the alignment between opposing connect or plates 150, each plate assembly can have a spring-loaded registration pin 162 and a pin receiving aperture 166 for mating with the registration pin extending from the opposing junction plate.

Moreover or alternatively, turning back to FIGS. 1–3, each housing 16 can contain dogs 17 projecting forward and outward from its outer surface to provide increased gathering and orientation between mating connectors 10. The housing 16 is attached to a bracket 11 extending from a coupler 12. Preferably, spring washers 38 are mounted between the housing 16 and the bracket 11.

Turning to FIGS. 8–12, railroad coupler assemblies 108 each consists of a coupler body 110 having a head 112 and a shank 114, a knuckle 116 rotatable from an open position 118 to a locked position 120 about a knuckle pin 122, a lock 134, a locklifter 136, a rotor 135, and a thrower 138. The coupler assembly 108 has a vertical centerplane 125 and a horizontal centerplane 127 which intersect to define a coupler centerline 132 coincident with the centerline of draft 129 of the car sill 130 and a pulling face 128 perpendicular to coupler centerline 132 at the intersection with the midpoint of the 'S' shaped pulling face convolution 131 of knuckle 116. The vertical position of the coupler centerline 132 is defined as the mid height of the knuckle pulling face convolution 131. In the locked position, the F coupler contour 124 contains the coupler front face 126 and the knuckle pulling face convolution 131.

The coupler is mounted with its centerline 132 along the centerline of draft 129 in the car sill 130 and striker 140. The pneumatic and electric connection between cars is provided by a resiliently supported connector plate 150 that is located slightly away from the knuckle pulling face 128 toward the coupler front face 126 such that pressure exists between the connector plates 150 of mated coupler assemblies 108 containing such connector plates 150.

The connector plate 150 is resiliently attached to the coupler knuckle 116 between its pulling face convolution 131 and the knuckle front face 133 to have a vertical centerline 152 in the coupler centerplane 125 at its front surface 154.

Connector plate 150 contains multiple holes for mechanical alignment as well as for pneumatic and electric connections between the connection plates of mated couplers. A central hole 156 for pressurized air transmission contains a seal 158 that projects rearward of surface 154 to contact and seal at surface 159 with a seal 158 of a mating coupler connector plate 150. At least one pin 160 has a conical end 162 projecting rearward from hole(s) 164 in plate 150 and conical holes(s) 166 have a compatible conical angle and are symmetrically located about centerline 152 from hole(s) 164 so that each pin 160 engages a hole 166 of a mated connector plate when the centerline of the mated connector plates are coincident. Holes 170 in plate 150 contain electrically insulating bushings 172 that locate the ends of conductor pin 174 and each hole 170, bushing 172 and pin 174 has a hole 170 and bushing 172 symmetrically located about centerline 152. Each pin 160 and 170 has a flange 176 to limit the rearward position of the pin by contact with connector plate 150 or by engaging conical surfaces of the pins. and the plate holes or bushings.

The bodies of pins 160 are surrounded by a compression spring 180. Pins 174 are surrounded by a compression spring 182 and an electrically insulating cylinder 184. Both types of springs are located within a pin guide block 177 and are held to a precompressed length by closure plate 178. The pressurized air line is sealed by contact between seal 158 and pin guide block 177 or to an air line fitting 188 secured to guide block 177. Closure plate 178 contains electrically insulating bushings 198 to guide one end of pins 174 and to provide a reaction surface for springs 182. 'S' shaped leaf spring 182 functions as a lateral gathering guide as well as a detent for holding plates 150 substantially together once they make contacts. The spring is retained between the guide block 176 and the closure plate 178 and provides a ramp around plate 150 of the mating connector by virtue of a relief chamber 185 in the mating guide block 177. The connector assembly is held together by countersunk screws 92 and nuts 94.

Connector assembly 190 rests upon the knuckle 116 at the top of its nose 200 at its flag hole 202 and has a hole 204 in it. A reinforcing bar 206 substantially the width of plate 150 also has a hole 208 and a bolt 210 passes through holes 208, 204, and 202 and is retained by a nut 212 at the bottom of the knuckle 216. Connector plate 150 also has a hole 214 that fits over pin 216 located in the knuckle top surface 200 to maintain proper orientation of connector assembly 190.

Connector assembly 190 is also effectively mounted to the bottom of the knuckle nose except for possible interference with the auxiliary interlocking lug 220 and the bottom shelf 122 of an F coupler or a mated F coupler.

As indicated previously, one of the operating constraints and design deficiencies encountered in standard coupler systems includes the limited gathering range between coupler heads—both laterally and vertically. Because of the limited horizontal gathering range of the AAR standard couplers, it is necessary for a workman to perform an unsafe function in certain operating conditions by going between the cars to manually position the couplers on adjacent cars to be within the limited gathering range. The frequency of the need to position couplers is dependent upon the car design itself including specific, coupler characteristics and upon the operating conditions, but it is a very dangerous procedure if the trainman is not totally clear when the engineer is signaled to proceed.

Attempted mating of couplers outside the gathering range may result in a bypassing of the couplers, with potential damage to the couplers, the adjacent car structure and lading, as well as potential injury to a trainman. The economic impact of such damage can be substantial in addition to the delay in shipment of the car lading.

Another operating constraint and design deficiency encountered in standard coupler systems is the very large displacement of car center line on small radius curves that require large coupler angling at the junction with tangent track. This again requires a trainman to position the coupler heads manually by going between adjacent cars.

Another problem is the limited availability of the alignment control feature which is never on end-of-car cushioning units or long shank couplers. This results in the coupler heads of long shank couplers not being centered and within the gathering range. Once again this might result in bypassing of couplers, unless the couplers are manually positioned.

Connection slack compounded by coupler wear and angling is another design deficiency with standard couplers. Free slack increases longitudinal forces between cars, resulting in higher levels of fatigue and wear of coupler and draft gear components.

Also, the necessity to accommodate large relative vertical movement between any coupler coupled to an E coupler is a frequently encountered problem. Unlike 'F' couplers, 'E' couplers are not the interlocking type and hence, the knuckles slide vertically relative to the other knuckle, requiring accommodations of large vertical movements of the coupler heads.

As stated above, another serious problem is the fact that cars today include only manually connected air lines. As previously mentioned, this requires a trainman to go in between trains, which is not only unsafe but also labor intensive. Further freight cars do not include electrical systems. This precludes the use of ECP braking systems on freight cars, unless more expensive radio communication systems are used. Also, there is the need to throw the knuckle open manually in order to couple cars.

Desirably, a coupler in accordance with the present invention is capable of coupling with a Standard coupler (mechanical connection only) and functioning with it in service on AAR approved cars and American Railway Engineering Association (AREA) recommended track geometry with minimal exceptions. Curving requirements are specified in Section C-II, Volume I, 2.1.4 'Vertical & Horizontal Cunes' of the AAR's 'Manual of Standards and Recommended Practices.'

Preferably, the coupler is compatible with the contours of a Standard coupler and function with a Standard coupler. This allows the concept to be retrofitted to existing couplers without requiring extensive modifications or replacement of the couplers, while maintaining the basic simplicity of operation of the AAR standard couplers.

Moreover, the inventive coupler provides strength comparable or superior, as appropriate, to a Standard coupler. The strength requirements of coupling systems are specified in Section B, M215-93, 3.0 'Design Criteria' & 5.0 'Test Requirements' of the AAR's 'Manual of Standards and Recommended Practices.' The design load requirements are explained in Section C-II, Volume I, 4. 1 'Coupler Loads' & 11 .3 'Coupler Test Requirements' of the AAR's 'Manual of Standards and Recommended Practices.'

In addition, the inventive coupler automatically provides a 1-¼" air line connection and the ability to be separated when the coupler is unlocked. The knuckle then opens to its fullest extent for subsequent coupling. The coupler is designed in accordance with the various sections of Section E, 'Brakes & Brake Equipment' of the AAR's 'Manual of Standards and Recommended Practices.' These include specifications on gaskets & air hoses ( M602-88), hose fittings & assemblies ( M927-83), air flow requirements (S471-92), and performance & exposure requirements (S4000 & S4001-88).

Preferably, the inventive coupler automatically provides a minimum of five electrical connections that can be connected to No. 8 gauge wires (0.128" diam.) and separate automatically when the coupler knuckle is opened. The electrical connectors and connected cables preferably satisfy the relevant requirements of the 'Performance Specifications for ECP Brake System Cable, Connectors & Junction Boxes', currently under development by the AAR.

It is also desired that each automatic air and electrical connector in accordance with the present invention is the same on both ends of each railroad car. They should either be located on or be symmetrical about the vertical centerline of the car or coupler.

Preferably, the automatic air and electrical connector is used with F couplers.

The interlocking characteristic of the F coupler provides gathering within its capability to within a narrow range that can be refined with the air and electric connector. Further, the extended objective of automatic electrical/air connection is the facilitation of ECP brake systems, where F type couplers are likely to be preferred over E type couplers. Also, F couplers because of their better design (reduced slack, reduced knuckle wear, etc.) and improved gathering range will offer higher reliability of the connection.

Figure 4:
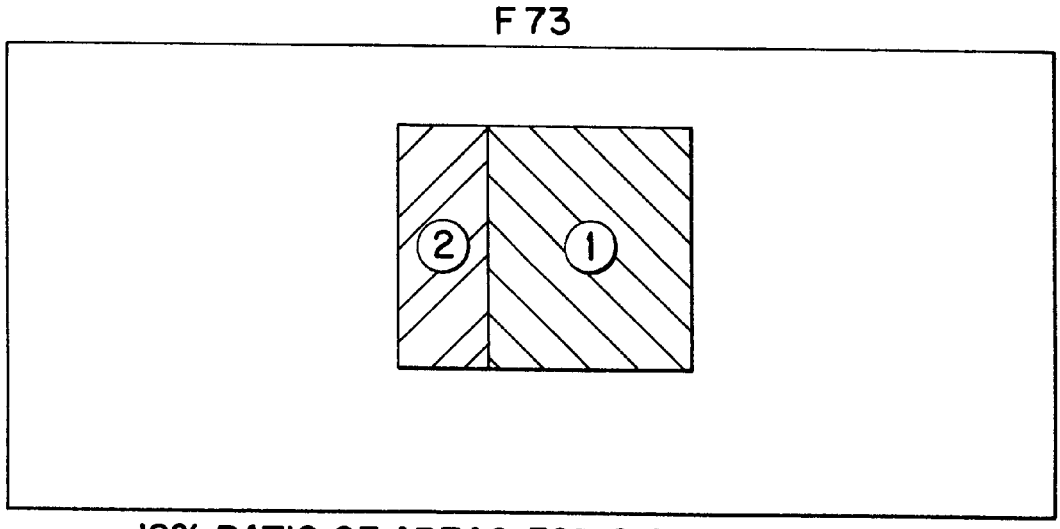
FIG. 4 depicts the envelope of the range of positions of the coupler centerline for theoretical curve negotiability and the gathering range provided by F couplers with one or two knuckles open.
Figure 4:
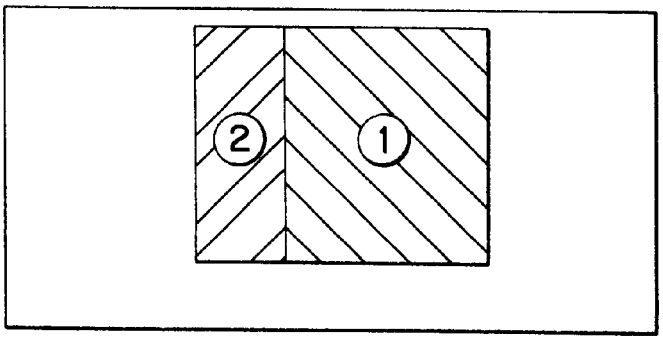
Figure 4:
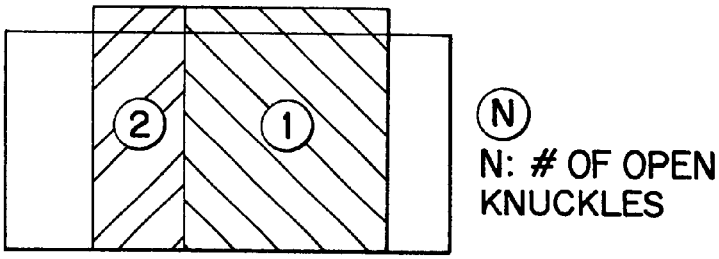
Figure 17:
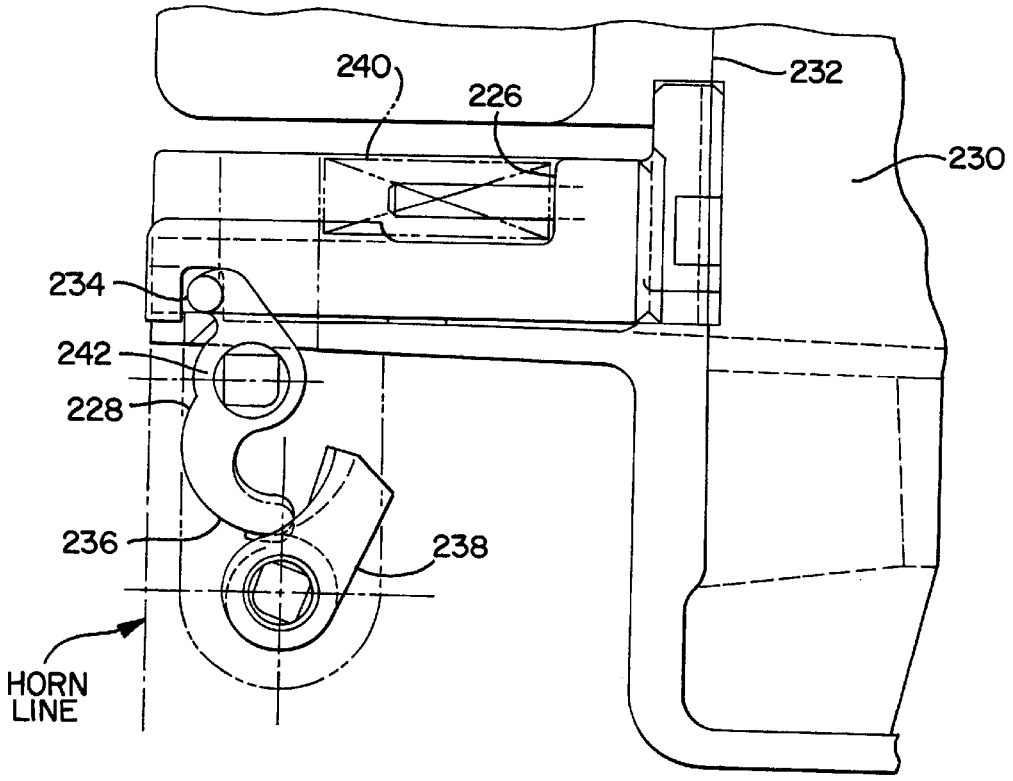
FIG. 17 is a sectional view through cavity "B" (i.e., parallel and between the centerline cavity of FIG. 10 and the external view of FIG. 18) of a coupler similar to that of FIG. 10 and including means for increasing the gathering range of the coupler; and, FIG. 18 is a side view, and in particular the guard arm side, of the railroad car coupler of FIGS. 1 and 17 with the connectors attached thereto.
Figure 18:
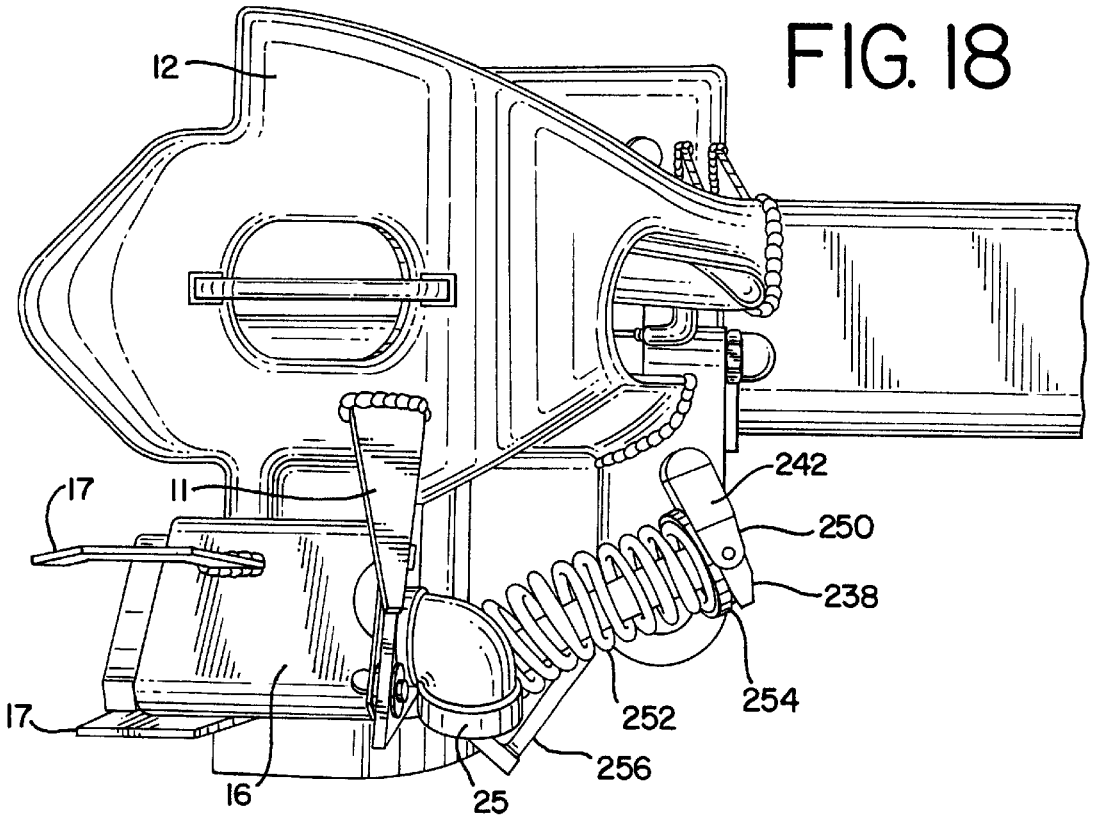

The horizontal gathering capability of the F coupler is controlled on the guard arm side by the lateral position of the guard arm nose and on the knuckle side by the knuckle nose position. FIG. 4 shows that the gathering range is extremely limited with only one knuckle open, but that it becomes substantially equal to that on the guard arm side when both knuckles are open. Therefore, the present invention increases the gathering range by a spring applied torque to the otherwise manually operated rotor 135 which reacts with the locklifter 136 to automatically open the knuckle through the standard linkage. The knuckle open in the absence of a knuckle (KOAK) feature is negated by the depression of the plunger by the mating coupler (not shown) to eliminate said rotor torque. Turning to FIGS. 17 and 18, the mechanism to accomplish this feature includes a plunger 226 that projects into the coupler contour 230 through the front face 232, a lever 228 with one leg 234 engaging the plunger and another leg 236 abutting rotor extension 238 and a spring 240 biasing the plunger outward. These elements are contained in a cavity B parallel and to the guard arm side of the cavity A containing the lock, locklifter and rotor. A pin 242 that is locked to lever 228 has an arm 250 projecting radially in a plane further toward the guard from cavity B to which is attached a spring 252 through a pivoted spring cap 254. This spring is oriented to produce negative or zero plunger opening force when the plunger is depressed and desirably is the primary torque input on the levers as the knuckle is opened and the plunger is depressed. It reacts onto a projection from the coupler body.

FIG. 4 also shows that the F70 type coupler's (28.75" long) gathering range with both knuckles open covers 66% of the envelope of the possible displacement from the adjacent car centerline. It also shows how much the envelope increases as the coupler length is increased to 43" and 60". Historically, as coupler lengths increased to accommodate the economics of larger cars, the coupler gathering range was not improved. To provide the necessary gathering to protect all coupler designs would necessitate massive projections on the coupler head that would prevent coupling with existing couplers.

Figure 5:
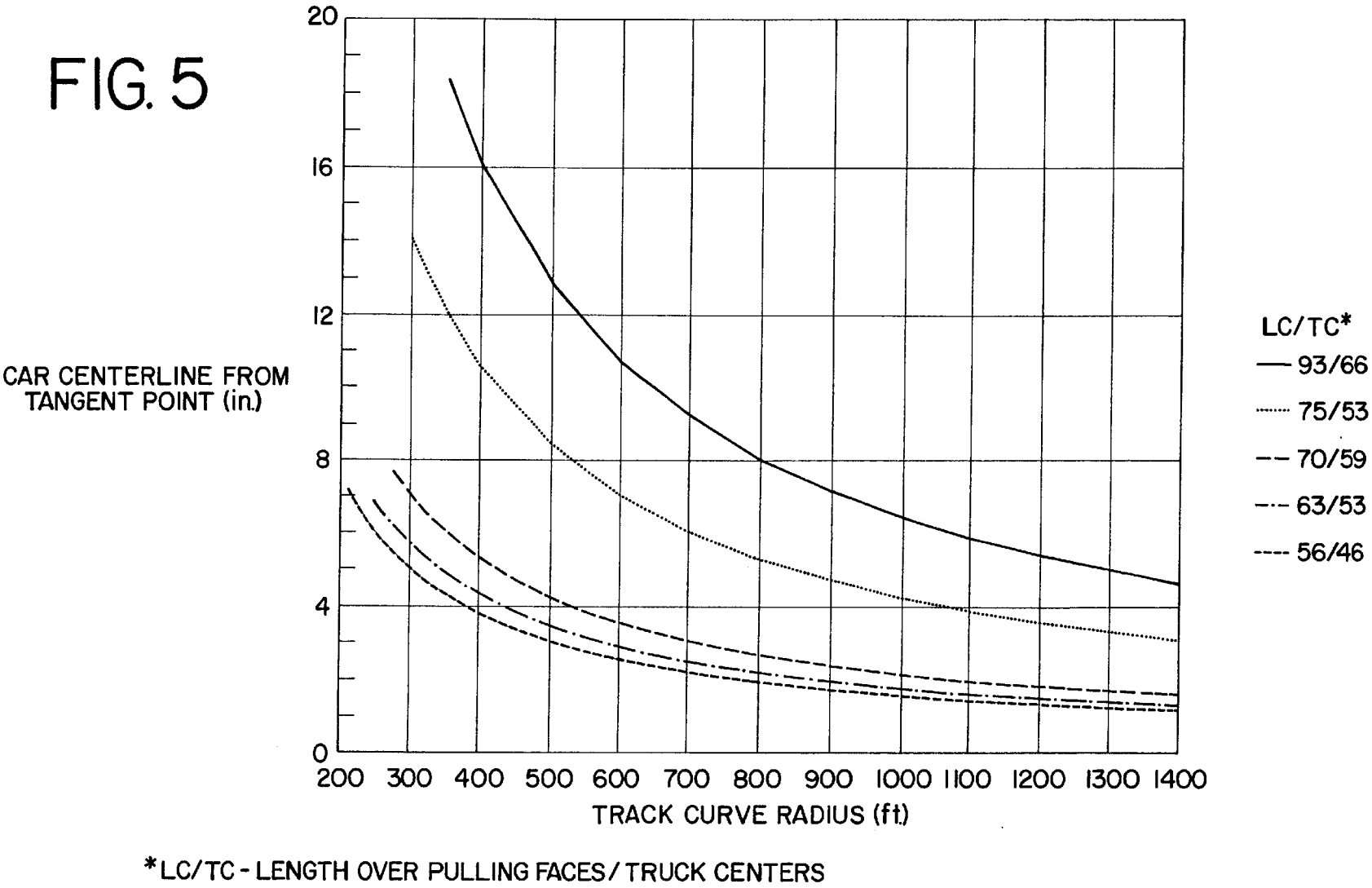
FIG. 5 is a graph of a car centerline distance from a track tangent point for various car geometries and various track curve radii.

The Standard short and intermediate length F couplers contain aligning shoulders that urge them toward the car centerline when they are not coupled; however, the lateral angle to which they are restored keeps increasing as these shoulders and the pin hole wear. In the late 1960's, a family of coupler centering devices was provided to the railroads. They limited lateral offset of approaching couplers but could not assure coupling at a curve-tangent junction or at a crossover. FIG. 5 is a graph of the car centerline distance from the tangent point for various car geometries and various track curve radii. Each curve represents a car on a range of curves.

The American Railway Engineering Association (AREA) recommends that a spiral curve be used both entering and exiting a curve. This limits the relative lateral displacement of the car center lines of adjacent cars on the spiral curve. For example, referring to the graph of FIG. 5, any pair of short cars, one on a 600 ft. and the other on an 800 ft. radii, would have their car center lines offset the difference between the curve height at those radii or less than an inch. Between 400 ft. and 800 ft. radii, the difference is approximately 2". Therefore, spiral curves up to at least 1500 ft. would allow coupling of almost all cars where the coupler is on the car centerline, except at turnouts and crossovers where spiral curves may not be used.

Since long shank couplers do not have aligning shoulders, there is no assurance that they will be located near the car centerline when uncoupled. For cars with such couplers or any used with end-of-car cushioning, it is desired that a mechanism to steer the coupler approximately in proportion to the track angle be used to position the coupler close to the track centerline when uncoupled. Over steering would be desirable to compensate for friction loss at the carrier where a low friction surface material is recommended. Cars so equipped would be expected to be coupled satisfactorily on all tracks including turnouts and crossovers.

Providing steering for the coupler would minimize the miscouplings predicted in the unshaded portion of the coupler location envelope in FIG. 4. Although AREA is less specific about the transition from vertical curves to vertically tangent track, it has been determined that spiral or parabolic curves are used adjacent to sharp vertical radii, and similar benefits, viz. satisfactory couplings, are anticipated regarding extreme vertical offsets.

The total slack between cars is the sum of slack between the couplers, free slack at the coupler connection to the yoke and draft gear travel at each car end. The slack between the couplers consists of initial free slack, wear of the lock and knuckle nose convolution and tail, as well as wear of the knuckle and coupler body pulling lugs and pin protectors. With the higher hardness of the grade E locks and the minimal movement and wear at the nose convolutions, most of the increase in slack is expected to result from wear of the knuckle and body pulling lugs and pin protectors and minor wear of the nose. Although increasing the contact area of the knuckle nose would be difficult, the pin protectors and pulling lugs and knuckle pin bearing areas could be substantially increased by the inclusion of body lugs at the mid height of the knuckle. Consideration could also be given to flame hardening those wear surfaces but caution should be taken to not initiate a failure due to a thermal notch.

Figure 7:
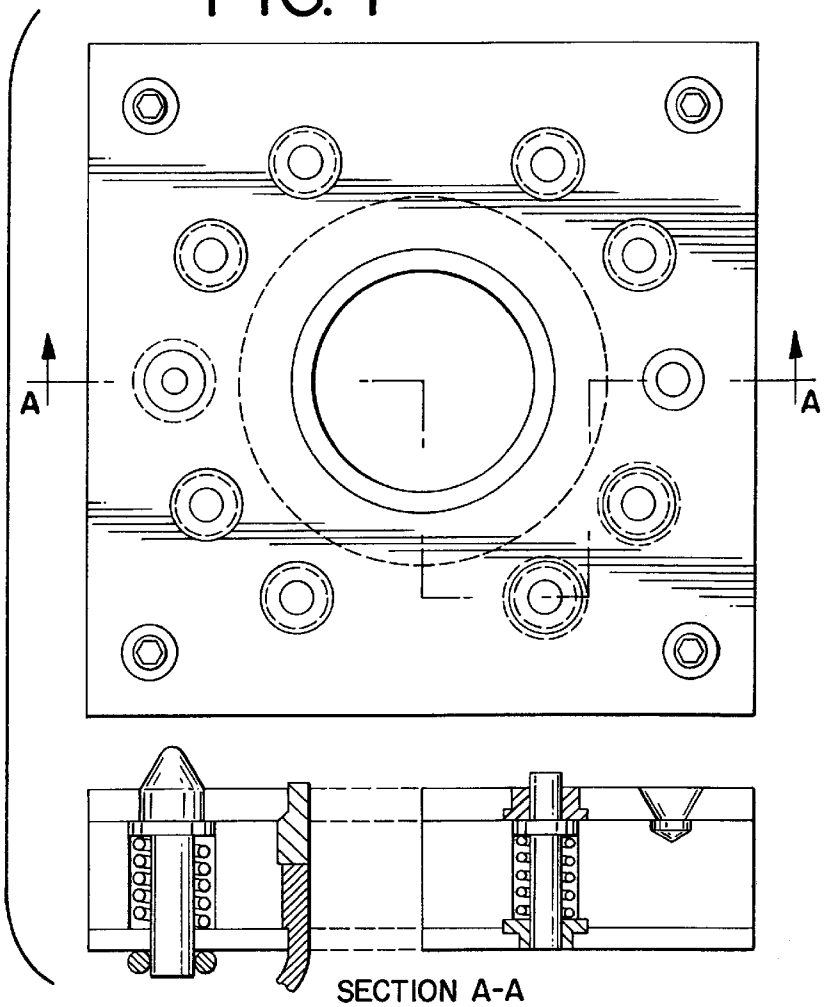
FIG. 7 provides an end view and a cross-sectional view of the connector of FIG. 6.
Figure 6:
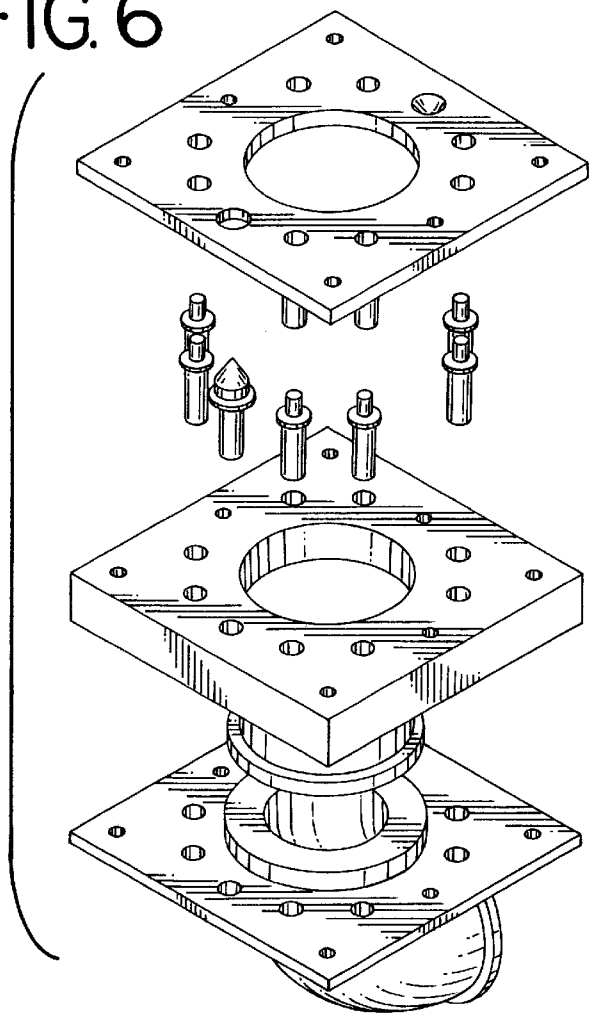
FIG. 6 a simplified exploded view of another embodiment of a connector in accordance with the present invention having a front plate.
Figure 8:
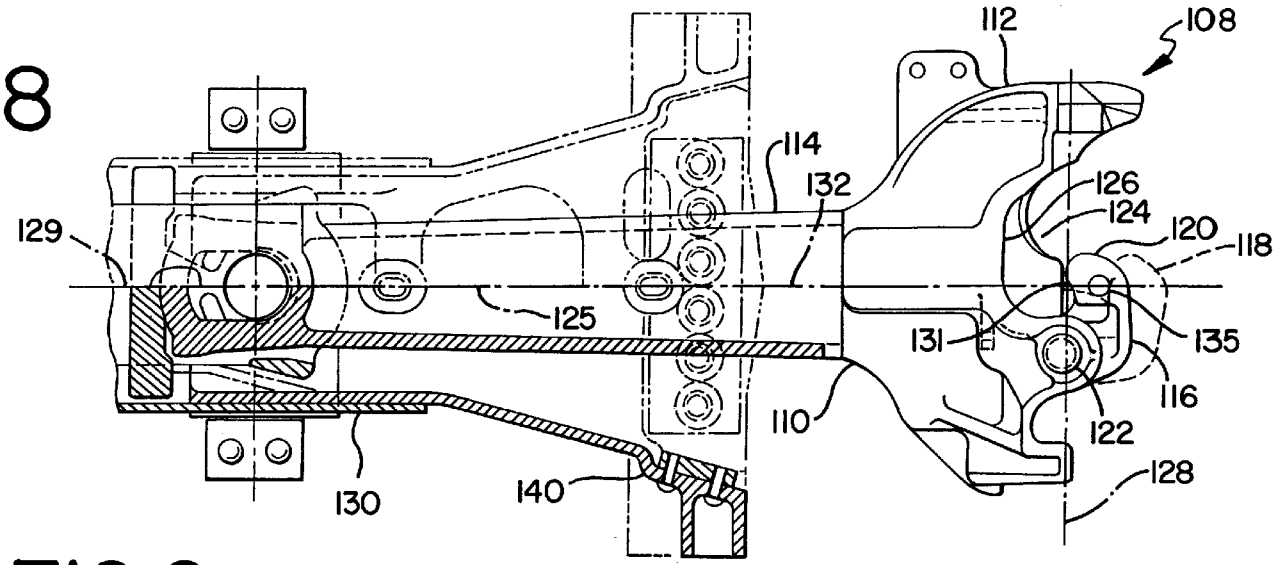
FIG. 8 a top plan view with half a sectional view at the centerline of draft of an F coupler and its yoke assembled in a car sill and striker assembly.
Figure 9:
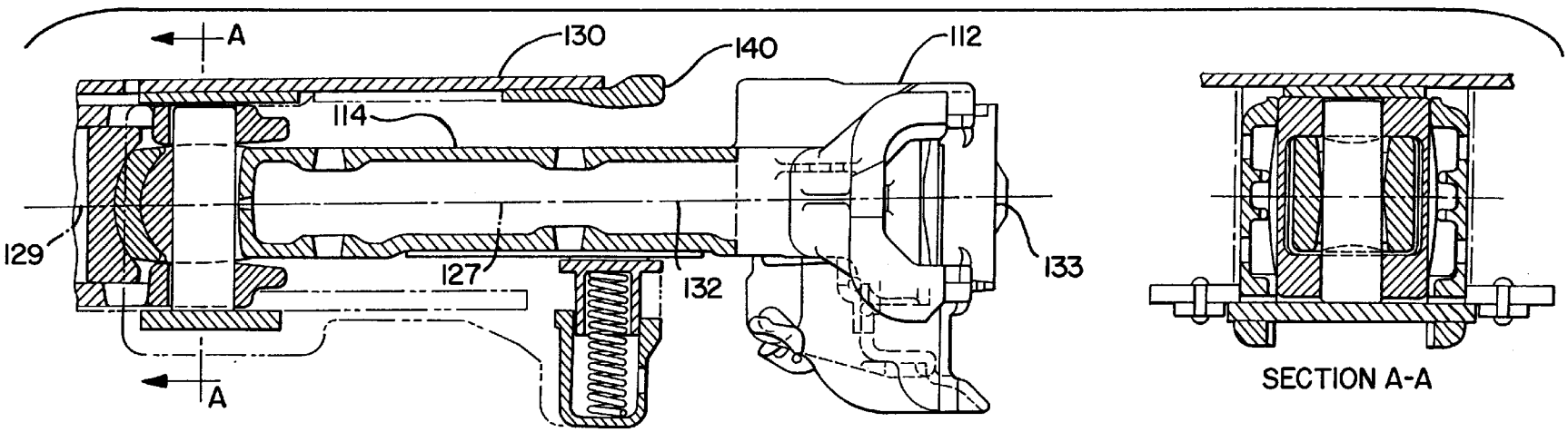
FIG. 9 is a vertical sectional view through the same combination of elements as in FIG. 8.
Figure 11:
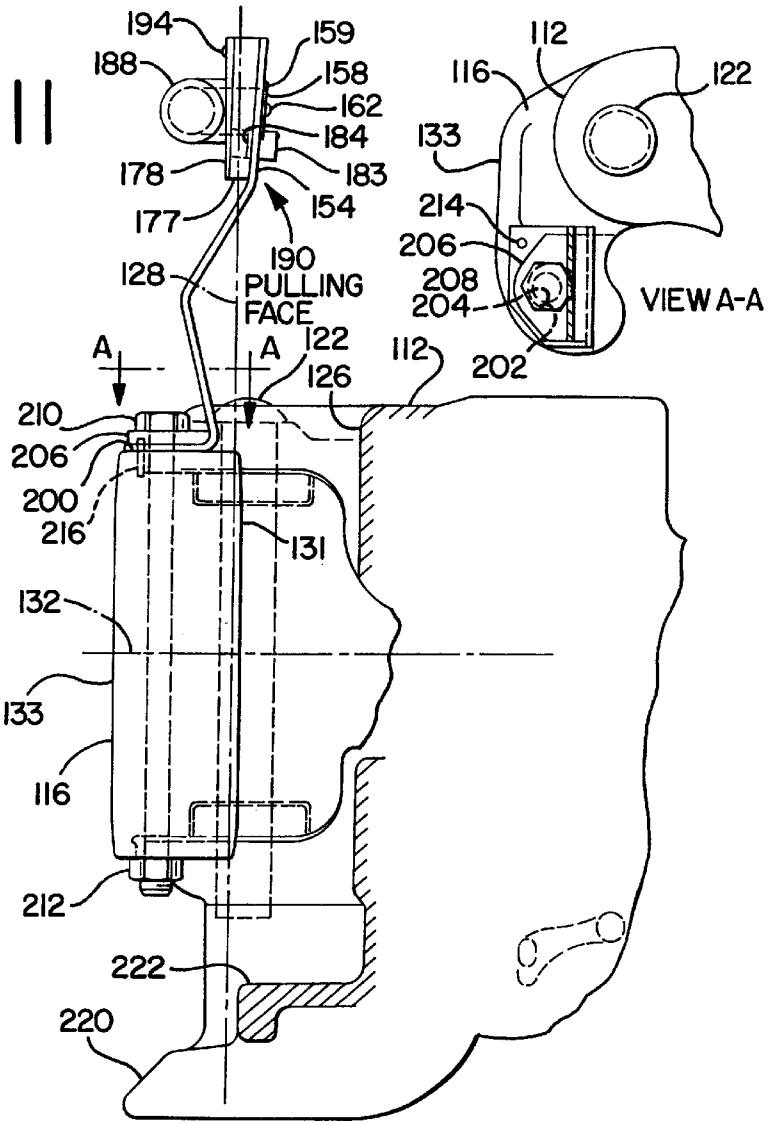
FIG 11 is a parallel sectional view as in FIG. 10 of an F coupler assembly showing the coupler body, knuckle and pin with an embodiment of an air and electric connector sign in accordance with the present invention attached to the knuckle, with view A-A providing a sectional view of the top of the knuckle.
Figure 10:
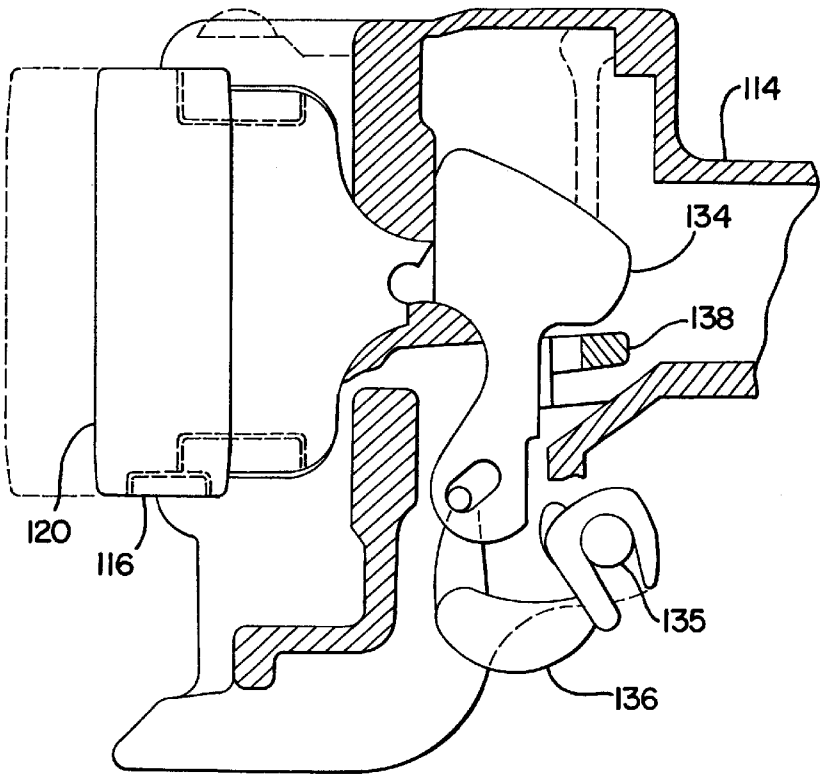
FIG. 10 is a vertical sectional view at the guard arm side of the lock chamber of an F coupler assembly looking toward the knuckle side showing the knuckle, lock, locklift assembly rotor shaft in locked position and also with the knuckle in the open position shown in phantom.

The basic design of an embodiment in accordance with the present invention (See FIGS. 6 and 7) consists of a spring and pin cage made of high resistivity material and has a central opening for air passage. Around that hole are eight cavities (two per quadrant) that each contain an electrical connector pin with a spring seat flange and a spring. At the approximate same diameter on one side is a hole that contains a gathering pin that has a spring seat flange and a conical end. At the time of coupling, the gathering pin will help to locate the two connecting units, so that the air and electrical connections may be aligned. Attachment screw holes are along the top and bottom of the cage.

A front plate, made of steel, contains an identical size air passage opening, eight holes lined with nonconductive grommets to accept the electrical connector pins, a hole to accept the gathering pin with its conical end protruding, and a symmetrical conical seat to receive the gathering pin of an identical pin on an adjacent coupler connector. Countersunk attachment screw holes are along the top and bottom of the plate.

A backing plate has a central hole through which extends one end of an air line elbow including a flange on the spring and pin cage side. An air grommet projects through the holes in the spring cage and front plate to seat and seal with an identical connection on an adjacent coupler. The elbow flange bears against the seal flange to form a sealed air line when the backing plate, cage and front plate are assembled. The backing plate also contains holes and nonconductive grommets around the backs of the connector pins and a hole for the back of the gathering pin. It also contains a set of tapped holes for screws to secure the assembly.

The electrical connector pins are made of copper and have a diameter of 0.25". The electrical connections are through flat face contact, that is maintained by sufficient spring force. The back of each connector pin contains a hole into which is soldered a no. 8 wire. The nonconducting grommets in the front and back plates, and the non- conducting spring cage provide the necessary level of insulation. However, alternate connection types, including pin-socket type arrangements and insulated face plates can also be used to provide sufficient levels of insulation.

The diameter of the air-connection (elbow & air-grommet) is the same as the diameter of a standard air line hose to ensure compatibility and to maintain airflow requirements. The airline ends in a gladhand so that an air connection can be made to existing brake pipe systems on current freight cars. This also makes the train line compatible between cars with Tricouplers and standard couplers.

Figure 15:
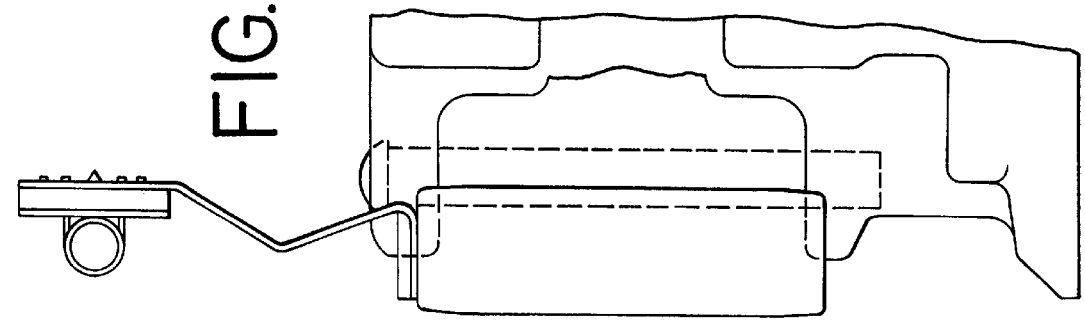
FIG. 15 is a side view of a coupler in accordance with the present invention mounted on a knuckle.
Figure 14:
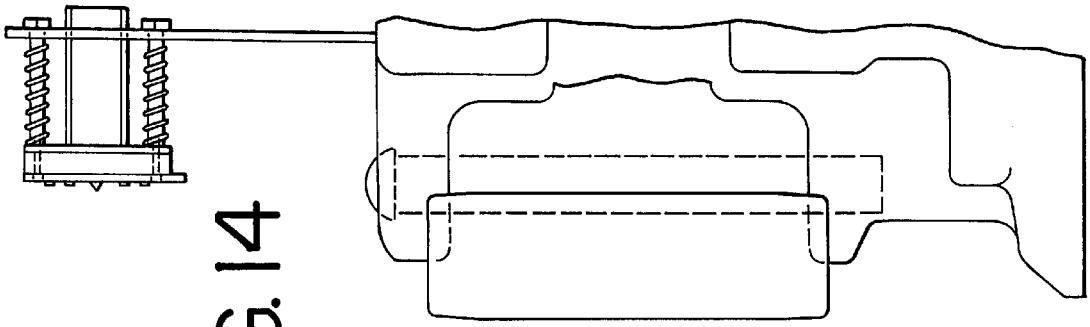
FIG. 14 is a side view of a coupler in accordance with the present invention mounted on a knuckle.
Figure 13:
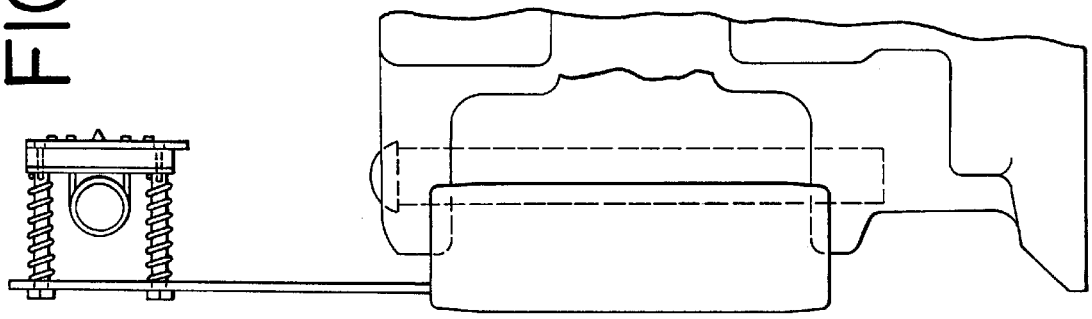
FIG. 13 is a side view of a coupler in accordance with the present invention mounted on a knuckle.

The connector longitudinal travel requirement is approximately one inch per coupler to allow for free contour slack, wear and contour angling effect at the connector. Throughout this travel a minimum force should be maintained between the connectors to seal the air between them and to maintain constant electrical contact. The connector assembly as described above can be mounted against a set of pre-compressed springs (herein referred to as Tricoupler A) whose support plate can be attached to either the coupler knuckle or to the coupler body as shown in FIGS. 13 and 14, respectively. It could also utilize a leaf spring as the front plate (herein referred to as Tricoupler B) mounted on either the coupler knuckle as shown in FIG. 15 or on the coupler body. Because it minimizes the number of parts, the leaf spring arrangements would be expected to be less expensive.

Figure 16:
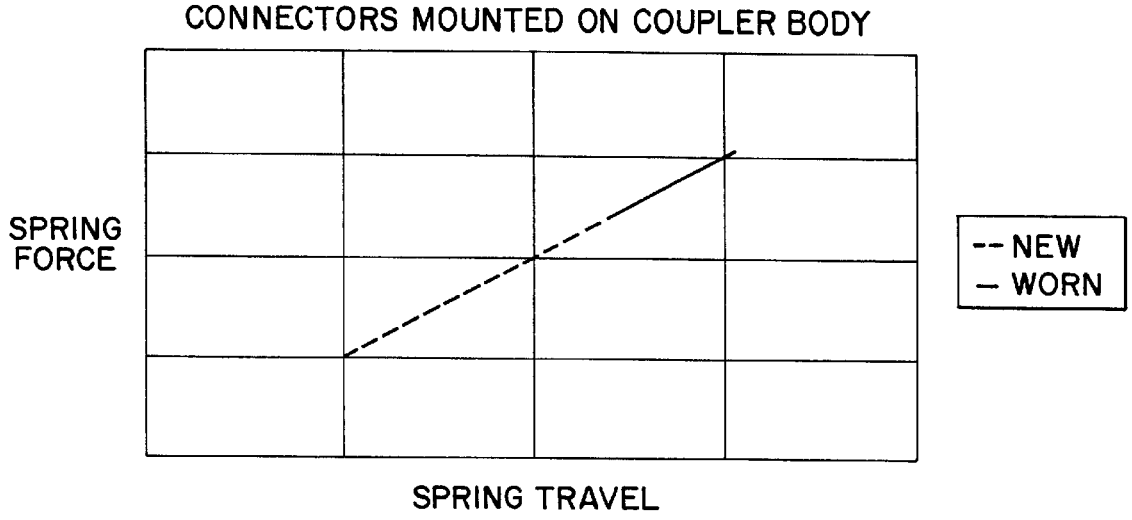
FIG. 16 provides charts depicting spring force verses spring travel for connectors mounted on a coupler body and a knuckle.
Figure 16:
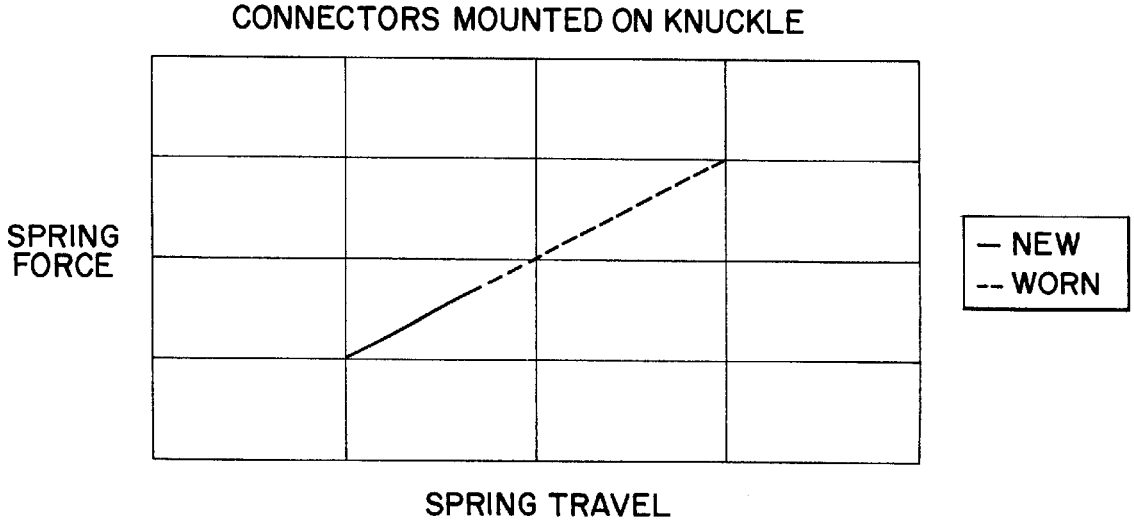

When the connector is mounted on the coupler head, the spring is compressed the maximum when it is new and the force reduces as the knuckle wears. When mounted on the knuckle, the springs provide the minimum force in buff when new and increase the connector interface force as the knuckles wear. These conditions are shown in the force-travel graph, FIG. 16.

The connector center is preferably located 14.5" above the coupler centerline so its lower edge (located 12.5" above to allow operation with most E type couplers) is just above the type SE coupler top shelf and slightly more above the type SF coupler top shelf. Therefore, the Tricoupler A mounted on the knuckle cannot be mated with an SE type coupler because of the necessary relative movement, and the mounting would interfere with a mated SF coupler top shelf. Tricoupler B would be able to couple and function with any AAR coupler except with an SE type coupler. The following table summarizes with which couplers that the Tricoupler can successfully mate.

| Coupler Type | Mounting Location | Can Couple | Cannot Couple |
|---|---|---|---|
| A | Coupler Body | E, SBE, F, SF | SE |
| A | Coupler Knuckle | E, SBB, F | SE, SF |
| B | Coupler Body | E, SBE, F, SF | SE |
| B | Coupler Knuckle | E, SBE, F | SE, SF |
| C | Coupler Body | B, SBE, SE, F, SF | None |

Connectors that are mounted on a knuckle preferably contain an elbow to connect to the car air line. Those mounted onto the coupler body can have a straight pipe attached to the connector back side.

Since connections are preferably mounted either on the vertical centerline or symmetrical about it, an alternate arrangement would make a Y from the 1¼" air line to parallel 1" lines on either side of the coupler. These smaller air lines along with half the number of electric connectors (referred to herein as Tricoupler C) could be located above the top lateral aligning surfaces on each side of the coupler or they could be located just outside the lower lateral aligning surfaces (see FIGS. 1 and 2). In either of those locations, the combination of air and electric should provide pressure over a 1" travel and the electric connectors must be separately sprung to assure constant contact. The same connector pins and springs would be expected to be used; however, only three contacts per side would be required in addition to the smaller airline seal. The Tricoupler C design would be capable of coupling and functioning with any other coupler, including the top shelf coupler types SE & SF.

While the specific embodiments have been illustrated and described, numerous modifications come to mind without significantly departing from the spirit of the invention and the scope of protection is only limited by the scope of the accompanying claims.

I claim:

1. A connector comprising:

a housing;

a junction plate having an open bore and an outer perimeter surrounded by the housing;

an elongated tube having a portion received within said bore;

a coil spring wrapped around the elongated tube and abutting against the housing and the junction plate; and, a plurality of spring-loaded electrical contacts symmetrically positioned about the opening of the bore, the contacts providing an electrical flow path when compressed.

2. The connector of claim 1 wherein the junction plate has a generally triangular perimeter.

3. The connector of claim 1 wherein the junction plate includes a front plate operably connected to a back plate.

4. The connector of claim 1 further comprising a tubular elbow operably connected to the elongated tube.

5. The connector of claim 1 further comprising a gasket mounted about the opening of the bore.

6. The connector of claim 1 further comprising a plurality of dogs attached to the housing.

7. The connector of claim 1 further comprising at least one registration pin operably connected to the junction plate.

8. A connector system comprising:

one or more housings with symmetry about a vertical centerplane of a coupler;

a junction plate associated with each housing having a hole containing a gasket and a perimeter closely surrounded by the housing;

an elongated tube bearing against the gasket and having a flange bearing against the junction plate; and, a plurality of spring loaded electrical contacts that provide an electrical flow path when compressed, the contacts positioned around the hole and symmetrically about the vertical centerplane.

9. The connector system of claim 8 wherein a resilient means of attachment of the housing to a rigid projection from the coupler permits limited translation of the junction plate with respect to the coupler body.

10. The connector system of claim 8 wherein each of the spring loaded electrical contacts projects out of the junction plate and has a flange that bears against a shoulder in a connector cavity of the junction plate and is surrounded by a spring that bears against a low conductivity flanged tube to preclude the presence of electricity in the projecting contact when not depressed.

11. The connector system of claim 8 wherein the coupler has a contour and a mechanism is provided within the coupler to apply torque to a locklifter for opening a knuckle in the absence of a mated knuckle in the contour of the coupler.

12. The connector system of claim 11 wherein the mechanism has a plunger biased outwardly by a spring and by a leg of a spring biased lever that offers assisting force to throw the knuckle open when the plunger is in an extended condition.

* * * * *

UNITED STATES PATENT AND TRADEMARK OFFICE

CERTIFICATE OF CORRECTION

PATENT NO. : 6,290,079 B1
DATED : September 18, 2001
INVENTOR(S) : Russell G. Altherr It is certified that error appears in the above-identified patent and that said Letters Patent is hereby corrected as shown below:

Column 2,
Line 38, after “in accordance” delete “ention” and insert -- with the invention --

Column 3,
Line 1, after “connector” delete “sign” and insert -- design --
Line 6, after “assembly” insert -- and --
Line 10, after “mounted on” delete “a knuckle” and insert -- a coupler body --

Column 4,
Line 33, after “opposing” delete “connector or” and insert -- connector --

Column 10,
Line 29, delete “B, SBE, SE, F, SF” and insert -- E, SBE, SE, F, SF --

Signed and Sealed this

Twenty-seventh Day of May, 2003

JAMES E. ROGAN
*Director of the United States Patent and Trademark Office*